US007731170B2

(12) United States Patent
Nishii et al.

(10) Patent No.: US 7,731,170 B2
(45) Date of Patent: Jun. 8, 2010

(54) OPEN/CLOSE MECHANISM FOR PAPER TRAY FOR USE IN IMAGE FORMING APPARATUS

(75) Inventors: Toshikane Nishii, Osaka (JP); Kazuhiro Wakamatsu, Ibaraki (JP); Yasuhide Ohkubo, Osaka (JP); Ippei Kimura, Osaka (JP); Mizuna Tanaka, Osaka (JP); Haruyuki Honda, Ibaraki (JP); Masafumi Takahira, Ibaraki (JP); Hiroshi Fujiwara, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 167 days.

(21) Appl. No.: 11/882,640

(22) Filed: Aug. 3, 2007

(65) Prior Publication Data

US 2008/0054554 A1 Mar. 6, 2008

(30) Foreign Application Priority Data

Aug. 3, 2006 (JP) ..... 2006-212370

(51) Int. Cl.
*B65H 3/44* (2006.01)

(52) U.S. Cl. ..... 271/9.09; 271/164

(58) Field of Classification Search ..... 271/9.09, 271/164, 9.11; 312/222, 333, 334.44, 334.46, 312/334.47; 399/392
See application file for complete search history.

(56) References Cited

U.S. PATENT DOCUMENTS

| | | | | |
|---|---|---|---|---|
| 4,186,977 | A * | 2/1980 | Gilovich et al. | 312/215 |
| 5,219,154 | A | 6/1993 | Fukube et al. | |
| 5,316,282 | A | 5/1994 | Fukube et al. | |
| 5,322,269 | A | 6/1994 | Fukube et al. | |
| 5,405,128 | A | 4/1995 | Fujiwara et al. | |
| 7,360,760 | B2 * | 4/2008 | Lin | 271/162 |
| 7,364,154 | B2 * | 4/2008 | Ichikawa et al. | 271/162 |
| 7,409,175 | B2 * | 8/2008 | Kim et al. | 399/107 |
| 7,568,690 | B2 * | 8/2009 | Kurokawa et al. | 271/9.09 |
| 2005/0269764 | A1 * | 12/2005 | Lee et al. | 271/171 |
| 2006/0290049 | A1 | 12/2006 | Fujiwara | |
| 2007/0065201 | A1 | 3/2007 | Fujiwara et al. | |

FOREIGN PATENT DOCUMENTS

| | | | |
|---|---|---|---|
| JP | HEI06-183579 | A | 7/1994 |
| JP | HEI07-152306 | A | 6/1995 |
| JP | 2001-114428 | A | 4/2001 |
| JP | 2001-217562 | A | 8/2001 |
| JP | 2002-362786 | A | 12/2002 |
| JP | 3728081 | B2 | 10/2005 |

* cited by examiner

*Primary Examiner*—Patrick Mackey
*Assistant Examiner*—Jeremy Severson
(74) *Attorney, Agent, or Firm*—Harness, Dickey & Pierce, P.L.C.

(57) ABSTRACT

An open/close mechanism can be used for paper trays of an image forming apparatus. The open/close mechanism includes a plate member provided on a side of a housing of the image forming apparatus and configured to pivot upon an axis between an open position and a close position, and a box member that is arranged in the housing beneath the plate member and that can be drawn out of the housing from the side. The open/close mechanism includes also includes a restricting unit that is coupled to the plate member and that abuts against the box member when the box member is set in the housing and when the plate member is in the open position thereby restricting detachment of the box member from the housing.

8 Claims, 6 Drawing Sheets

OPEN/CLOSE MECHANISM FOR PAPER TRAY FOR USE IN IMAGE FORMING APPARATUS

CROSS-REFERENCE TO RELATED APPLICATIONS

The present application claims priority to and incorporates by reference the entire contents of Japanese priority document, 2006-212370 filed in Japan on Aug. 3, 2006.

BACKGROUND OF THE INVENTION

1. Field of the Invention

The present invention generally relates to an open/close mechanism for trays for stacking paper (paper trays) in image forming apparatuses. More particularly, the present invention relates to the open/close mechanism for paper trays that is arranged on a housing of an image forming apparatus.

2. Description of the Related Art

In a typical image forming apparatus, such as a printer, a copying machine, and a facsimile, in addition to feeding a paper to an image forming unit from an easily detachable paper cassette provided on the image forming apparatus, a paper can also be fed from an openable-and-closable manual paper-feeding tray provided on a housing of the image forming apparatus. Image forming apparatuses of this type are disclosed in Japanese Patent No. 3728081 and Japanese Patent Application Laid-Open No. 2002-362786.

A conventional image forming apparatus disclosed in Japanese Patent No. 3728081 has a link member, one end of which is pivotably supported by a housing of the image forming apparatus while the other end of which is pivotably supported by the openable-and-closable manual paper-feeding tray. The link member retains the manual paper-feeding tray at a predetermined angle.

In another conventional image forming apparatus disclosed in Japanese Patent Application Laid-Open No. 2002-362786, a front cover is retained at a predetermined angle with a belt. In addition to the manual paper-feeding tray, the image forming apparatus includes a detachable paper feeding unit.

In recent years, how to downsize the image forming apparatuses has become a major issue. If a link or a belt is used for attaching the manual paper-feeding tray to the housing as in the conventional techniques, the size of the image forming apparatus increases by an amount corresponding to the link or the belt. Thus, it is difficult to downsize the image forming apparatus.

A typical paper feeding tray usually has a lock mechanism that restricts detachment or attachment of the paper feeding tray from the housing. Such lock mechanism requires space and therefore increases the size of the image forming apparatus.

SUMMARY OF THE INVENTION

It is an object of the present invention to at least partially solve the problems in the conventional technology.

According to an aspect of the present invention, there is provided an open/close mechanism for a housing including a plate member provided on a side of the housing and configured to pivot upon an axis between an open position and a close position; a box member that is arranged in the housing beneath the plate member and that can be drawn out of the housing from the side; and a restricting unit that is coupled to the plate member and that abuts against the box member when the box member is set in the housing and when the plate member is in the open position thereby restricting detachment of the box member from the housing.

According to another aspect of the present invention, there is provided an image forming apparatus including an open/close mechanism including a plate member provided on a side of a housing of the image forming apparatus and configured to pivot upon an axis between an open position and a close position, the plate member configured to stack paper; a box member that is arranged in the housing beneath the plate member and that can be drawn out of the housing from the side, the box member configured to stack paper; and a restricting unit that is coupled to the plate member and that abuts against the box member when the box member is set in the housing and when the plate member is in the open position thereby restricting detachment of the box member from the housing; an image forming unit provided inside the housing, the image forming unit configured to form an image on a paper; and a paper carrying mechanism configured to carry a paper from any one of the box member and the plate member to the image forming unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

Figure 1:
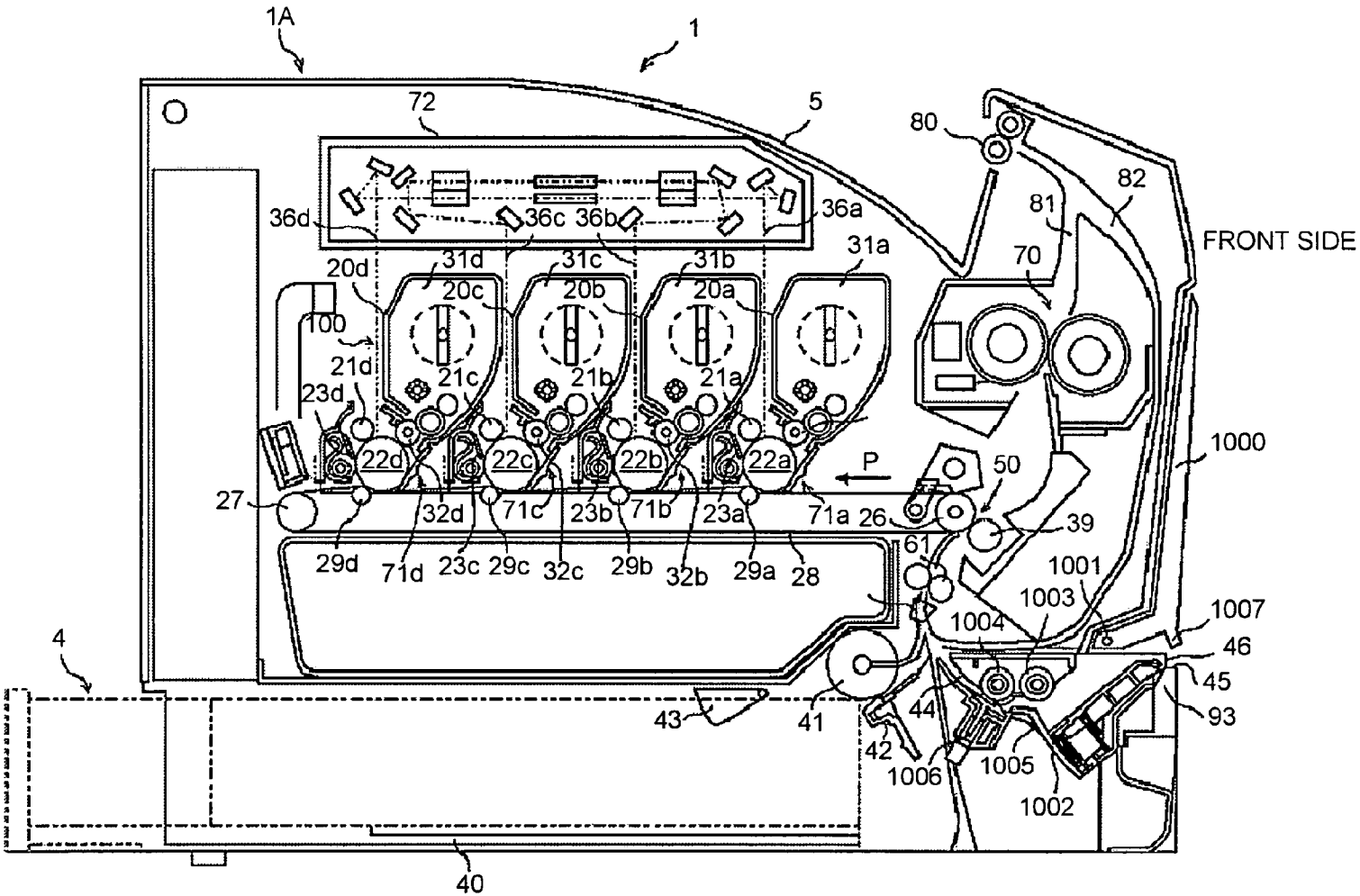
FIG. 1 is a side view of an image forming apparatus according to a first embodiment of the present invention.

FIG. 1 is a schematic diagram of an image forming apparatus 1 according to a first embodiment of the present invention. The image forming apparatus 1 is, although not limited, a tandem-type color printer. The color printer 1 includes four toner image forming units 71*a* to 71*d*, each of which forms a toner image in a specific color. The toner image forming units 71*a* to 71*d* are arranged in along the direction of movement of an intermediate transfer belt 28. The toner images formed on the toner image forming units 71*a* to 71*d* are sequentially transferred on the intermediate transfer belt 28. The color printer 1 shown in FIG. 1 uses electrophotography to form and transfer images. However, another technology such as ink jet recording can also be used instead of the electrophotography.

The color printer 1 includes a main-body housing 1A that houses an image forming unit 100 in entirety. The image forming unit 100 is positioned at about the heightwise center of the main-body housing 1A. An optical scanning device 72 is arranged above the image forming unit 100 and a paper feeding unit 4 is arranged below the image forming unit 100. The paper feeding unit 4 includes a paper cassette 40 that functions as a tray in which recording material (hereinafter, "papers") can be stacked.

Each of the toner image forming units 71*a* to 71*d* functions as a latent image carrier and has an identical structure. Each of the toner image forming units 71*a* to 71*d* includes a corresponding image carrying unit 20*a* to 20*d*. Each of the image carrying units 20*a* to 20*d* further includes corresponding photosensitive drums 22*a* to 22*d* that rotate in clockwise direction, charging rollers 21*a* to 21*d* used for electrically charging the photosensitive drums and located adjacent to and abutting against the corresponding photosensitive drums 22*a* to 22*d*, image developing units 31*a* to 31*d* having corresponding developing rollers 32*a* to 32*d* that develop latent images formed on the surface of the respective photosensitive drums 22*a* to 22*d*, and cleaning units 23*a* to 23*d* that have blades to scrape out any residual toner on the corresponding photosensitive drums 22*a* to 22*d*.

The charging rollers 21*a* to 21*d* uniformly electrically charge the corresponding photosensitive drums 22*a* to 22*d* with a default high voltage. The photosensitive drums 22*a* to 22*d* are then selectively exposed to light based on image data by using corresponding laser beams 36*a* to 36*d* emitted from the optical scanning device 72. The voltage at portions that are exposed to light decreases and an electrostatic latent image is formed on the photosensitive drums 22*a* to 22*d* due to presence of different-voltage portions on the surface of the photosensitive drums 22*a* to 22*d*.

The image developing units 31*a* to 31*d* develop the corresponding electrostatic latent image into corresponding toner images by applying toners onto the photosensitive drums 22*a* to 22*d*.

The image developing units 31*a* to 31*d* are arranged inside a housing of the image carrying units 20*a* to 20*d*. As the photosensitive drums 22*a* to 22*d* rotate in clockwise direction, the toner images on the surface of the photosensitive drums 22*a* to 22*d* move towards a primary transfer position described later.

Timing for forming a latent image and forming a toner image by developing is adjusted, so that the image carrying units 20*a* to 20*d* can work collaboratively. As described later in detail, four toner images in single color of cyan, magenta, yellow, and black are primary-transferred in sequence from the corresponding image carrying units 20*a* to 20*d* onto a top surface of the intermediate transfer belt 28 and are superimposed on one another to form a toner image in full color. The top surface of the intermediate transfer belt 28, which is the surface that faces the image carrying units 20*a* to 20*d*, moves in a direction shown by an arrow mark P.

Thus, in the toner image forming unit 71*a*, a first single-color toner image transferred onto the intermediate transfer belt 28 reaches a first abutting portion of the intermediate transfer belt 28 and the photosensitive drum 22*a*. As soon as the first single-color toner image reaches the first abutting portion, the photosensitive drum 22*b* of the adjoining toner image forming unit 71*b* performs an identical process of forming a single-color toner image as described above in case of the toner image forming unit 71*a*. That is, the image developing unit 31*b* develops an electrostatic latent image on the photosensitive drum 22*b* to form a second single-color toner image. The second single-color toner image is carried over the intermediate transfer belt 28, where the second single-color toner image is superimposed on the first single-color toner image. The superimposed toner image is then transferred to the toner image forming units 71*c* and 71*d* respectively. Same process of forming and superimposing a single-color toner image is repeated in the toner image forming units 71*c* and 71*d* respectively, and a toner image in full color is formed.

A negative bias voltage of superposed alternate current and direct current from a bias power supply (not shown) is applied to a cored bar of each of the developing rollers 32*a* to 32*d*. A negative bias voltage of direct current from another bias power supply (not shown) is applied to each of the charging rollers 21*a* to 21*d* that in turn charge the corresponding photosensitive drums 22*a* to 22*d*. Four primary transfer rollers 29*a* to 29*d* are arranged on the inner side of the intermediate transfer belt 28 at the abutting portion of the corresponding photosensitive drums 22*a* to 22*d* and the intermediate transfer belt 28. The primary transfer rollers 29*a* to 29*d* are used at the time of intermediate transfer of the single-color toner images.

The color of developer used in the image developing units 31*a* to 31*d* is mutually different. Four toners in single color of cyan, yellow, magenta, and-black are used in the corresponding image carrying units 20*a* to 20*d*.

The intermediate transfer belt 28 is stretched at the right end around a driving roller 26, which protrudes at the right side of the image forming unit 100, and is stretched at the left end around a driven roller 27, which is arranged at the left side of the image forming unit 100. The intermediate transfer belt that is supported by the driving roller 26 and the driven roller 27 is rotated in anticlockwise direction. A secondary transfer roller 39 is arranged to oppose to the driving roller 26. The driving roller 26, the secondary transfer roller 39, and a transfer nip between those two rollers constitute a secondary transfer unit 50. In FIG. 1, the intermediate transfer belt 28 has its surface retained parallel to the horizontal plane. The image carrying units 20*a* to 20*d* are arranged along the surface of the intermediate transfer belt 28. The corresponding photosensitive drums 22*a* to 22*d* are also arranged along and abut against the surface of the intermediate transfer belt 28.

The primary transfer rollers 29*a* to 29*d* push the intermediate transfer belt 28 so that the corresponding photosensitive drums 22*a* to 22*d* abut against the top surface of the intermediate transfer belt 28. When the intermediate transfer belt 28 rotates, four single-color toner images transferred from the photosensitive drums 22*a* to 22*d*, which are abutted against the top surface of the intermediate transfer belt 28, are sequentially transferred and superimposed on one another to form the toner image in full color. The toner image in full color is batch transferred to a paper by the secondary transfer unit 50 by using the secondary transfer roller 39.

Two different operations can be selected with respect to the toner image in full color that is transferred on the paper. In case of the first operation, the toner image in full color is fixed at a fixing unit 70. A copy releasing unit 80 that is made of a pair of rollers outputs to a copy receiving tray 5 the paper with the fixed toner image that is carried through a copy releasing path 81. In case of the Second operation, the paper with the toner image in full color is re-circulated to the secondary transfer unit 50. In case of the first operation the toner image is recorded only on one side of a paper, while in case of the first operation the toner image is recorded on both sides of a paper. To record on both sides of a paper, the paper is carried via a re-circulating path described later and inverted before reaching the secondary transfer unit 50.

The paper feeding unit 4 is arranged right below the toner image forming units 71*a* to 71*d*. The paper feeding unit 4 includes the paper cassette 40 that can be attached to or detached from the main-body housing 1A in horizontal direction in FIG. 1 by using a handgrip 93. The paper cassette 40 includes a paper stacking member on which papers are stacked and a paper feeding member unit to feed the papers. The paper stacking member can be a stacking plate that is pushed upwards by an urging unit (not shown). A first paper-feeding roller 41 functions as the paper feeding member to feed the papers stacked in the paper cassette 40. The paper feeding unit 4 also includes a first friction pad 42 that separates out a single sheet of paper from a bundle of stacked papers, a paper checking unit 43 that checks whether there is a paper stacked in the paper cassette 40, a paper stop sensor 60 that sets a paper-stop timing when carrying a paper from the paper cassette 40 or from a manual paper path 44 described later, a paper stop roller 61 that feeds the paper to the secondary transfer unit 50 based on the paper-stop timing, a re-circulating path 82 that is used at the time of two-sided image forming, and a path switching unit (not shown) that is used to switch over the paper path at the time of two-sided image forming.

The first paper-feeding roller 41, the paper stop sensor 60 and the paper stop roller 61 are integrally arranged in the main-body housing 1A. On the other hand, the paper cassette 40, the first friction pad 42, and the manual paper path 44 are integrally arranged in a paper cassette case that can be attached to and detached from the main-body housing 1A without any interference. The size of the paper cassette 40 can be varied (shown with dotted line in FIG. 1) to suit for stacking large size papers.

The re-circulating path 82 diverges from the copy releasing path 81 and laterally bypasses the image forming unit 100 before remerging in the copy releasing path 81 in front of the paper stop roller 61. Hence, a paper inserted in the re-circulating path 82 is re-circulated towards the paper stop roller 61 and follows the same paper path as that of a paper fed from the paper cassette 40.

In case of one side recording, i.e., forming an image on only one side of a paper, the copy releasing unit 80 outputs to the copy receiving tray 5 the paper with the fixed toner image in full color that is carried through the copy releasing path 81. In case of two-sided recording, i.e., forming images on both sides of a paper, the paper with the fixed toner image in full color that is recorded on one side is first carried through the copy releasing path 81 until the rear end of the paper reaches the copy releasing unit 80. The copy releasing unit 80 then reverses its rotating direction and switches back the paper towards the re-circulating path 82. The switched back paper is re-circulated to the paper stop roller 61 until the front end of the paper reaches the paper stop roller 61. The paper stop roller 61 then feeds the switched back paper to the secondary transfer unit 50.

Figure 2:
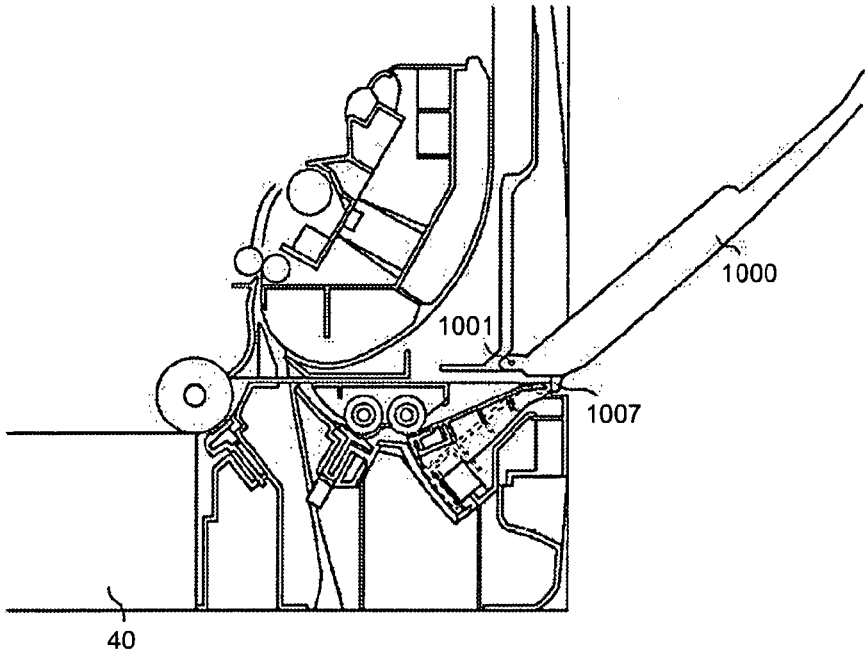
FIG. 2 is a detailed side view of an open/close mechanism for paper trays shown in FIG. 1.

In addition to the paper feeding unit 4, a manual paper-feeding unit 1000 configured to pivot upon a shaft 1001 is provided on the front side of the image forming apparatus (right side in FIG. 1). The manual paper-feeding unit 1000 is pulled open to stack a paper on a stacking plate. The paper is said to be properly stacked when the front end of the paper touches a stopper 1005 arranged in the front part of the paper cassette case of the paper feeding unit 4. In response to a request for recording, a solenoid (not shown) elevates an elevating plate 1002 so that the elevating plate 1002 abuts against a second feeding roller 1003 that rotates in clockwise direction. (In FIG. 1, the elevating plate 1002 is shown in a resting position. In FIG. 2, the elevating plate 1002 is shown both in the resting position (dotted line) and an elevated position (solid line) abutting against the second feeding roller 1003).

A friction member is provided on the surface of the elevating plate 1002 that helps in separating out the uppermost single sheet of paper from a bundle of stacked papers due to friction between the uppermost paper and the second feeding roller 1003. However, when feeding a paper from three or more sheets of paper stacked, the second feeding roller 1003 may mistakenly feed multiple sheets of paper if the force of the second feeding roller 1003 to feed the papers is stronger than the friction between two adjoining sheets of paper. To avoid such problem, another paper separating mechanism is provided to separate a single sheet of paper. That mechanism includes a paper-separating roller 1004 that rotates in clockwise direction and is arranged on the downstream of the second feeding roller 1003, and a second friction pad 1006 that abuts against the paper-separating roller 1004. The separated sheet of paper is then carried through the manual paper path 44 and fed to the secondary transfer unit 50 by following the same paper path as that of a paper fed from the paper cassette 40.

As shown in FIGS. 1 and 2, a protrusion 1007 is integrally provided at the bottom on the front surface of the manual paper-feeding unit 1000, while a depression is provided at the top right corner of the paper cassette case of the paper feeding unit 4. When the manual paper-feeding unit 1000 is in an open position, the horizontal apical surface of the protrusion 1007 abuts against a top horizontal surface 45 of the depression, while the inner vertical surface of the protrusion 1007 abuts against a vertical surface 46 of the depression. That is, when the manual paper-feeding unit 1000 is in the open position, the protrusion 1007 is accommodated into the depression. Hence, when the manual paper-feeding unit 1000 is pulled open, abutting of the apical horizontal surface of the protrusion 1007 and the top horizontal surface 45 of the depression restricts further opening of the manual paper-feeding unit 1000, while abutting of the inner vertical surface of the protrusion 1007 and the vertical surface 46 of the depression restricts rattling of the manual paper-feeding unit 1000. Thus, the load on the shaft 1001 can be substantially reduced. Moreover, the manual paper-feeding unit 1000 can be retained at a predetermined angle without using conventional sliding members such as a link member or a belt. Elimination of sliding members also helps in reducing the thickness of the manual paper-feeding unit 1000 and eventually downsizing the image forming apparatus.

Consider a case in which the shaft 1001 is arranged straight below the manual paper-feeding unit 1000 in a close position. In such a case, when the manual paper-feeding unit 1000 is kept in the open position, the bottom of the manual paper-feeding unit 1000 interferes with the top of the front surface of the paper cassette case of the paper feeding unit 4. However, the shaft 1001 is arranged inside and away from the paper stacking surface. Moreover, the bottom of the manual paper-feeding unit 1000 is cutout at an upward slant with respect to the shaft 1001. Such structure avoids interference between the manual paper-feeding unit 1000 and the paper cassette case of the paper feeding unit 4.

As described above, a sheet of paper stacked in the manual paper-feeding unit 1000 follows the same paper path as that of a sheet of paper stacked in the paper feeding unit 4. Hence, if the paper cassette case of the paper feeding unit 4 is not properly attached to the main-body housing 1A, the manual paper-feeding unit 1000 cannot be retained at a correct angle. As a result, when a bundle of papers is stacked in the manual paper-feeding unit 1000, the front end of the undermost sheet of paper does not properly touch the stopper 1005, causing bad alignment of the rear end of papers in the bundle. It is very easy for a user to notice such bad alignment and understand that the paper cassette case of the paper feeding unit 4 is not properly attached to the main-body housing 1A.

Moreover, because the two surfaces of the protrusion 1007 abut against the top horizontal surface 45 and the vertical surface 46 of the depression, that is, because the protrusion 1007 is accommodated into the depression, detachment of the paper cassette case of the paper feeding unit 4 is restricted. Hence, when the manual paper-feeding unit 1000 is in the open position for use, abrupt detachment of the paper cassette case of the paper feeding unit 4 can be prevented.

Figure 3:
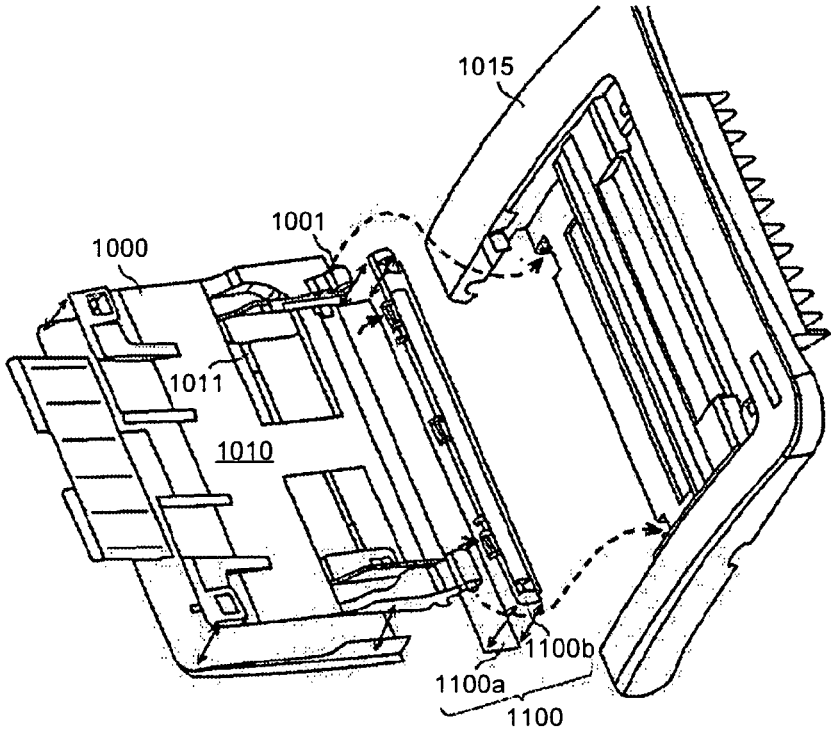
FIG. 3 is a perspective view of a manual paper-feeding unit of an open/close mechanism for paper trays according to a second embodiment of the present invention.
Figure 4:
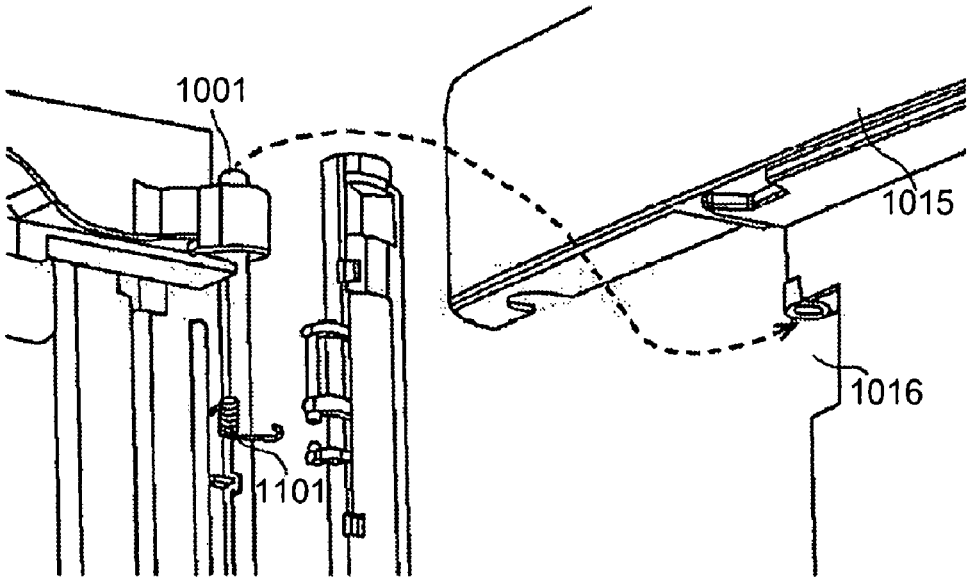
FIG. 4 is an enlarged view of a shaft of the manual paper-feeding unit and a flap-shaped restricting unit that restricts detachment of a paper feeding unit shown in FIG. 3.
Figure 5:
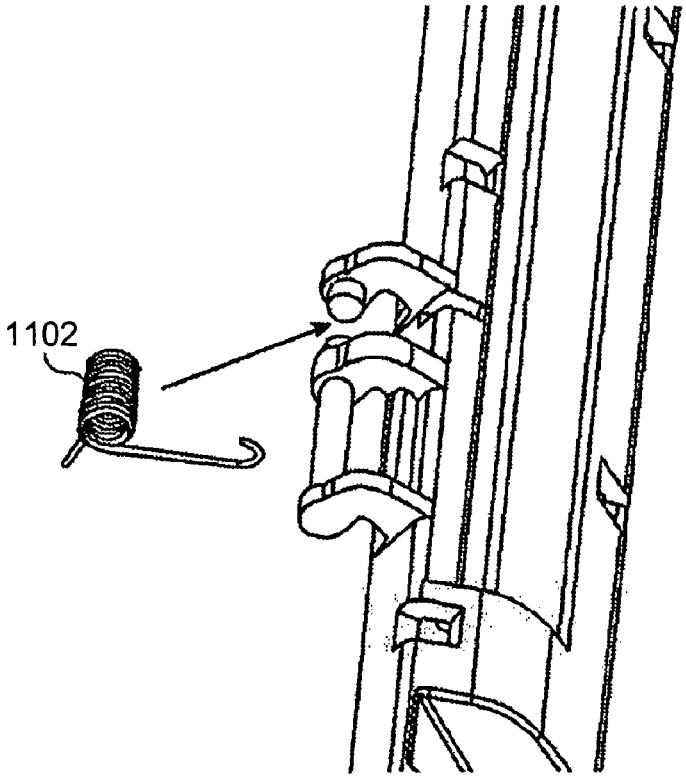
FIG. 5 is a perspective view of a torsion coil spring attached to the flap-shaped restricting unit shown in FIG. 3.
Figure 6:
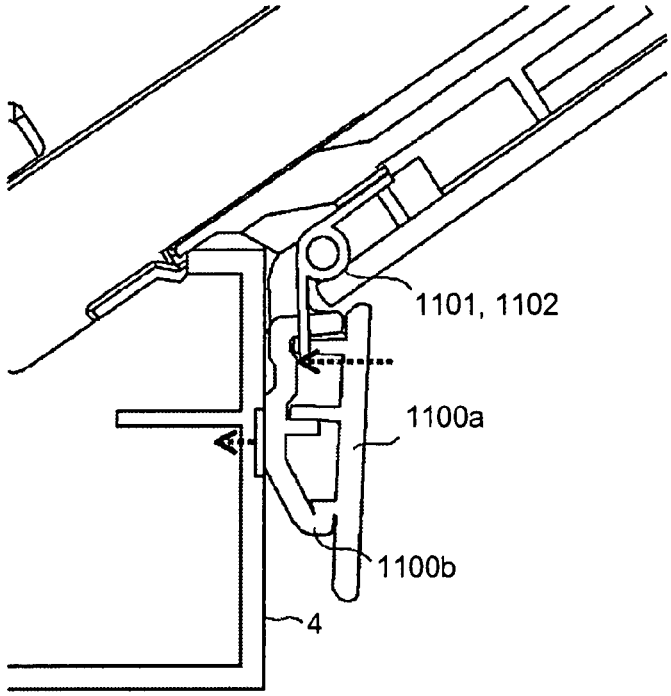
FIG. 6 is an enlarged perspective view for explaining details of the flap-shaped restricting unit shown in FIG. 3.

A manual paper-feeding unit of an open/close mechanism for paper trays according to a second embodiment of the present invention is described below. The image forming apparatus and the paper feeding unit 4 have identical structures as described in the first embodiment. Thus, the same explanation is not repeated. FIG. 3 is a perspective view of the manual paper-feeding unit 1000. The manual paper-feeding unit 1000 has an identical structure as described in the first embodiment. That is, the manual paper-feeding unit 1000 is a combination of two plates, namely a paper stacking surface 1010 and a front cover 1015 arranged together. The paper stacking surface 1010 allows stacking papers by reference to the center of the surface with the help of a guide member 1011, both ends of which move isometrically. As shown in an enlarged view of the shaft 1001 of the manual paper-feeding unit 1000 in FIG. 4, the shaft 1001 is accommodated into and rotatable upon a depression 1016 provided in the front cover 1015 of the main-body housing 1A of the image forming apparatus. A flap-shaped restricting unit 1100 provided on the manual paper-feeding unit 1000 restricts the detachment of the paper feeding unit 4 from the main-body housing 1A. As shown in FIG. 3, the restricting unit 1100 includes a first restricting member 1100*a* and a second restricting member 1100*b*. A first torsion coil spring 1101 and a second torsion coil spring 1102 are provided at two separate positions along the longitudinal axis of the restricting unit 1100 (shown in FIGS. 4 and 5). One end of both the first torsion coil spring 1101 and the second torsion coil spring 1102 is fixed to the manual paper-feeding unit 1000. As shown in FIG. 6, the first torsion coil spring 1101 and the second torsion coil spring 1102 are arranged to make the restricting unit 1100 abut against the paper cassette case of the paper feeding unit 4. The bottom end of the second restricting member 1100*b* is upwardly slanted towards the manual paper-feeding unit 1000 and slides over the front surface of the paper cassette case of the paper feeding unit 4.

Figure 7:
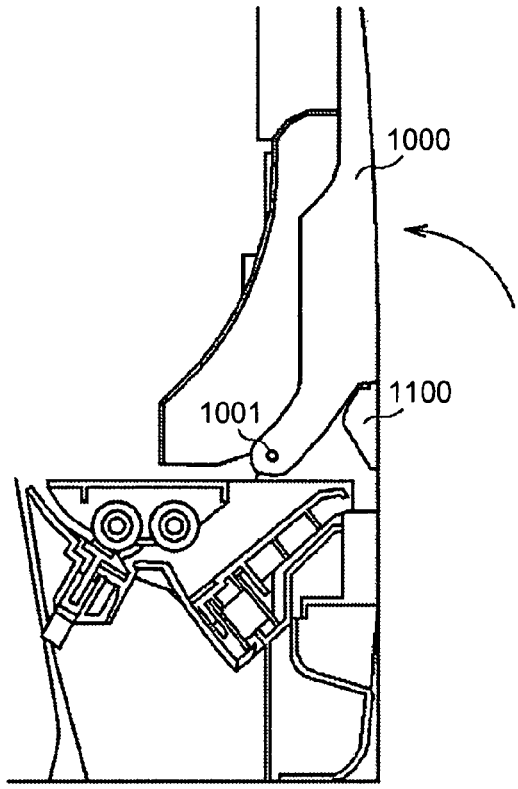
FIG. 7 is an enlarged side view for explaining position of the flap-shaped restricting unit shown in FIG. 3 when the manual paper-feeding unit shown in FIG. 3 is in a closed position.
Figure 8:
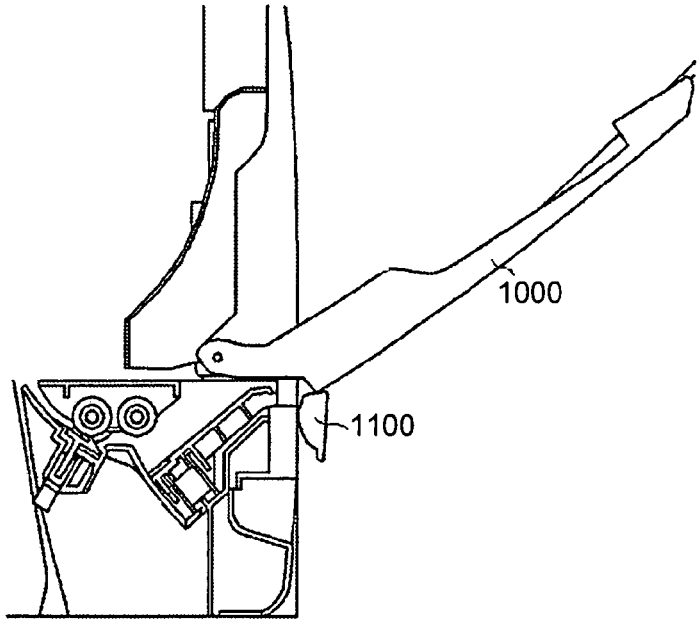
FIG. 8 is an enlarged side view for explaining position of the flap-shaped restricting unit shown in FIG. 3 when the manual paper-feeding unit shown in FIG. 3 is in an open position.

As shown in FIG. 7, when the manual paper-feeding unit 1000 is not in use, that is, when the manual paper-feeding unit 1000 is in the close position, the front surface of the restricting unit 1100 and the front surface of the manual paper-feeding unit 1000 form a continuous surface. When the manual paper-feeding unit 1000 is in the open position, slanting surface of the second restricting member 1100*b* slides over the front surface of the paper cassette case of the paper feeding unit 4, while the restricting unit 1100 moves around a point of support at which it is attached to the manual paper-feeding unit 1000. FIG. 8 is a side view for explaining the position of the restricting unit 1100 when the manual paper-feeding unit 1000 is in the open position. In the open position, the first torsion coil spring 1101 and the second torsion coil spring 1102 make the restricting unit 1100 abut against the paper cassette case of the paper feeding unit 4. If one tries to forcibly move the restricting unit 1100 away from the paper feeding unit 4 and against the force of the first torsion coil spring 1101 and the second torsion coil spring 1102, the top end of the first torsion coil spring 1101 interferes with the bottom end of the manual paper-feeding unit 1000 (as shown in FIG. 6). As a result, the restricting unit 1100 remains abutted to the paper cassette case of the paper feeding unit 4, thereby restricting abrupt detachment of the paper feeding unit 4. Hence, problem of paper jams occurring inside a paper path, through which papers from the paper feeding unit 4 are fed, can be prevented.

A manual paper-feeding unit of an open/close mechanism for paper trays according to a third embodiment of the present invention is described below. The image forming apparatus and the paper feeding unit 4 have identical structures as described in the first and second embodiments. The third embodiment is a combination of the first and second embodiments.

Figure 9:
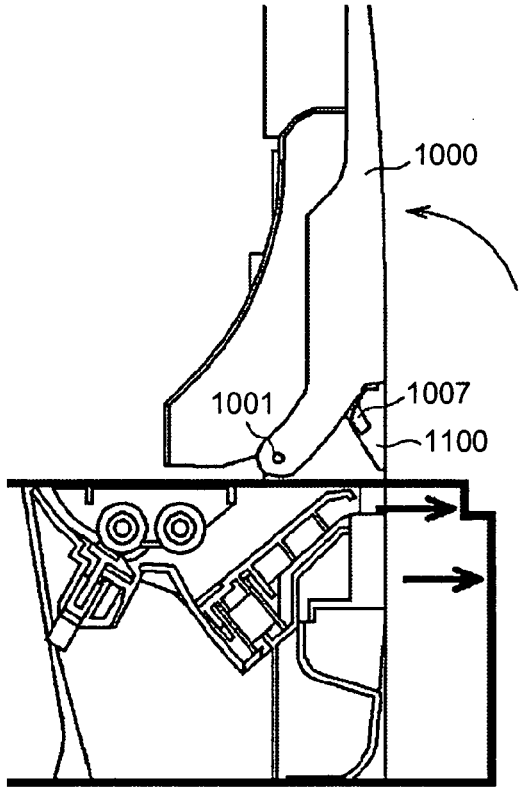
FIG. 9 is an enlarged side view for explaining position of a restricting unit when a manual paper-feeding unit in an open/close mechanism for paper trays according to a third embodiment of the present invention is in a closed position.
Figure 10:
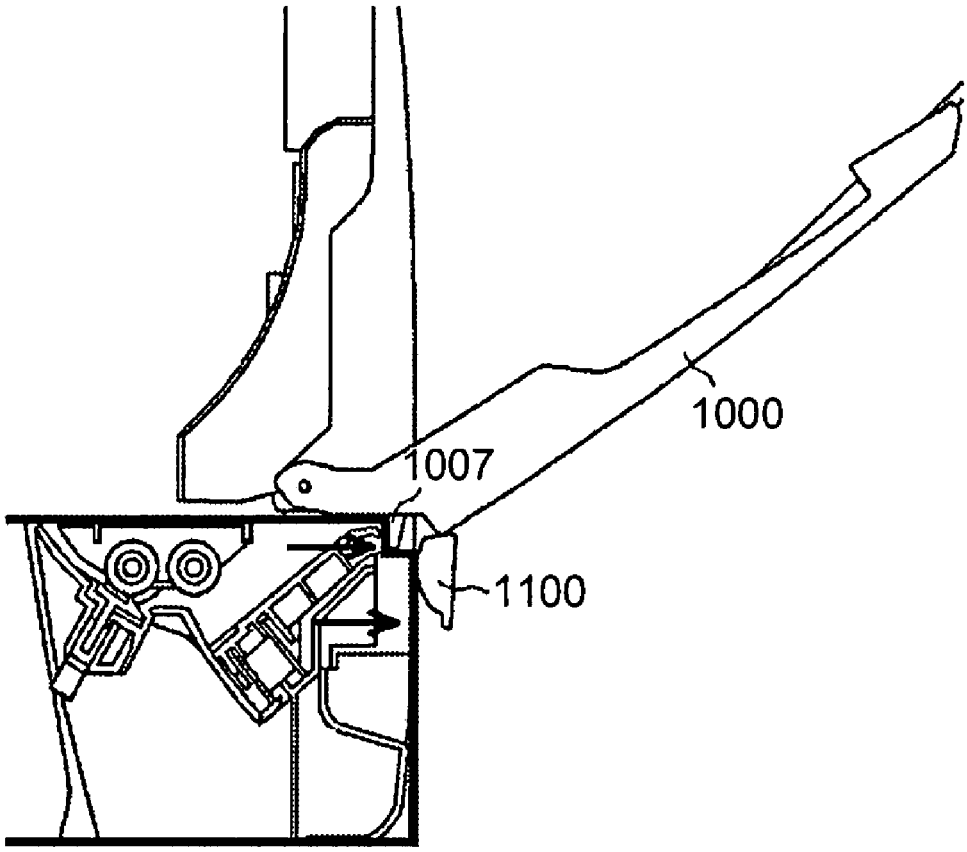
FIG. 10 is an enlarged side view for explaining position of the restricting unit shown in FIG. 9 when the manual paper-feeding unit shown in FIG. 9 is in an open position.

As shown in FIG. 9, when the-manual paper-feeding unit 1000 is in the close position, the paper cassette case of the paper feeding unit 4 can be detached from the image forming apparatus. As shown in FIG. 10, when the manual paper-feeding unit 1000 is in the open position, that is, when the manual paper-feeding unit 1000 is in use, the protrusion 1007 and the restricting unit 1100 restrict abrupt detachment of the paper cassette case of the paper feeding unit 4. Hence, problem of paper jams occurring inside a paper path, through which papers from the paper feeding unit 4 are fed, can be prevented.

According to embodiments of the present invention, abrupt detachment of a paper cassette can be easily restricted and an image forming apparatus can be downsized.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An open/close mechanism for a housing, the open/close mechanism comprising:

a plate member provided on a side of the housing and configured to pivot upon an axis between an open position and a close position;

a box member that is arranged in the housing beneath the plate member and that can be drawn out of the housing from the side: and a restricting unit that is coupled to the plate member and that abuts against the box member when the box member is set in the housing and when the plate member is in the open position thereby restricting detachment of the box member from the housing, wherein the housing is a housing of an image forming apparatus, the plate member is a plate tray and the box member is a box tray configured to stack paper, and the open/close mechanism further comprising:

a paper carrying mechanism configured to carry a paper from any one of the box member and the plate member to an image forming unit of the image forming apparatus.

2. The open/close mechanism according to claim 1, wherein the restricting unit is a protruding member attached to the plate member, the box member has a depression on the side, and when the box member is set in the housing and when the plate member is in the open position, the protruding member is accommodated into the depression thereby restricting detachment of the box member.

3. The open/close mechanism according to claim 1, wherein the restricting unit is a flap member that is coupled to the housing and that is pivotable independent of opening and closing of the plate member, the open/close mechanism further comprising an urging member that, when the box member is set in the housing and when the plate member is in the open position, moves the flap member so as to abut against a side of the box member thereby restricting detachment of the box member.

4. The image forming apparatus according to claim 1, wherein the box member is arranged in the housing beneath the plate member when the plate member is in the close position and can be drawn out of the housing from the side.

5. An image forming apparatus comprising:

an open/close mechanism including a plate member provided on a side of a housing of the image forming apparatus and configured to pivot upon an axis between an open position and a close position, the plate member configured to stack paper;

a box member that is arranged in the housing beneath the plate member and that can be drawn out of the housing from the side, the box member configured to stack paper; and a restricting unit that is coupled to the plate member and that abuts against the box member when the box member is set in the housing and when the plate member is in the open position thereby restricting detachment of the box member from the housing;

an image forming unit provided inside the housing, the image forming unit configured to form an image on a paper; and a paper carrying mechanism configured to carry a paper from any one of the box member and the plate member to the image forming unit.

6. The image forming apparatus according to claim 5, further comprising an inverted-paper carrying mechanism that inverts a paper, which has once passed through the image forming unit, and carries the inverted paper again to the image forming unit.

7. The image forming apparatus according to claim 5, wherein the box member is arranged in the housing beneath the plate member when the plate member is in the close position and can be drawn out of the housing from the side.

8. An image forming apparatus comprising:

an open/close mechanism including a plate member provided on a side of a housing of the image forming apparatus and configured to pivot upon an axis between an open position and a close position, the plate member configured to stack paper;

a box member that is arranged in the housing beneath the plate member when the plate member is in the close position and that can be drawn out of the housing from the side, the box member configured to stack paper; and a restricting unit that is coupled to the plate member and that abuts against the box member when the box member is set in the housing and when the plate member is in the open position thereby restricting detachment of the box member from the housing;

an image forming unit provided inside the housing; and a paper carrying mechanism configured to carry a paper from any one of the box member and the plate member to the image forming unit.

* * * * *